US009181749B1

(12) United States Patent
Davis

(10) Patent No.: US 9,181,749 B1
(45) Date of Patent: Nov. 10, 2015

(54) DEFORMABLE HINGE GAP BLOCKER FOR THE PROTECTION OF HANDS AND FINGERS

(71) Applicant: Raymond E Davis, Dallas, TX (US)

(72) Inventor: Raymond E Davis, Dallas, TX (US)

( * ) Notice: Subject to any disclaimer, the term of this patent is extended or adjusted under 35 U.S.C. 154(b) by 0 days.

(21) Appl. No.: 14/639,853

(22) Filed: Mar. 5, 2015

(51) Int. Cl.
*E05D 11/00* (2006.01)
*E06B 7/36* (2006.01)

(52) U.S. Cl.
CPC ..... *E06B 7/367* (2013.01); *E05D 11/0054* (2013.01); *E06B 7/36* (2013.01)

(58) Field of Classification Search
CPC ..... E06B 7/367; E06B 7/36; E05D 11/0054
USPC ..... 49/383, 384, 506
See application file for complete search history.

(56) References Cited

U.S. PATENT DOCUMENTS 5,092,077 A * 3/1992 Teinturier-Milgram ..... 49/383
6,141,909 A * 11/2000 Hanson ..... 49/303
7,155,776 B2 1/2007 Park
7,281,300 B2 10/2007 Andersen et al.
7,331,617 B2 2/2008 Johnson
7,416,230 B2 8/2008 Konstantakis et al.
7,537,250 B1 5/2009 Gustafson
2003/0070256 A1 4/2003 Kuwica
2010/0088962 A1* 4/2010 McRoskey ..... 49/303
2012/0210648 A1* 8/2012 Yang ..... 49/383

FOREIGN PATENT DOCUMENTS

FR 2746139 A1 * 9/1997 ..... E06B 3/88
FR 2756864 A1 * 6/1998

* cited by examiner

*Primary Examiner* — Jerry Redman
(74) *Attorney, Agent, or Firm* — John Gregory Baker

(57) ABSTRACT

This invention relates to a hinge stile gap blocking apparatus designed to prevent hand and finger injuries resulting from inadvertent door closures. The apparatus includes a hinge gap blocker for use with an existing door and door surround configured to continuously occlude a gap between the door jamb and the outer facing edge of a door hinge stile. The hinge stile gap blocking apparatus has a vaulted portion that is shaped to cover the exposed hinge barrels of a door. When installed, the hinge gap blocker covers exposed hinge barrels and continuously occludes the outside hinge gap between the door and door jamb when the door is pivoted.

13 Claims, 5 Drawing Sheets

224
210
210
2
2
220

220
210
210

220
210
224
220

210
224
224
224
210
212
212
224
220

210
224
224
210
224
212
212
210
220
212
224
224

210
224
224
212

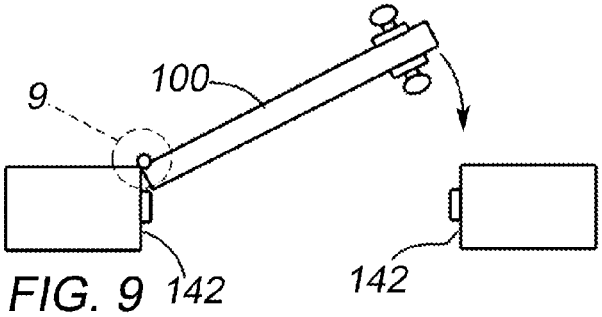
FIG. 9
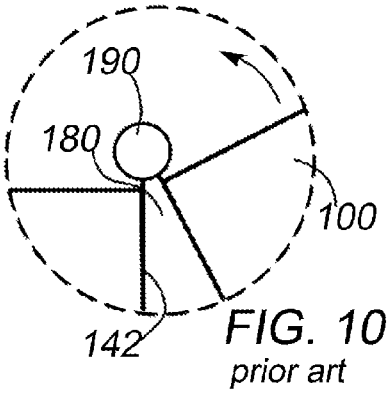
FIG. 10
prior art
FIG. 11
prior art
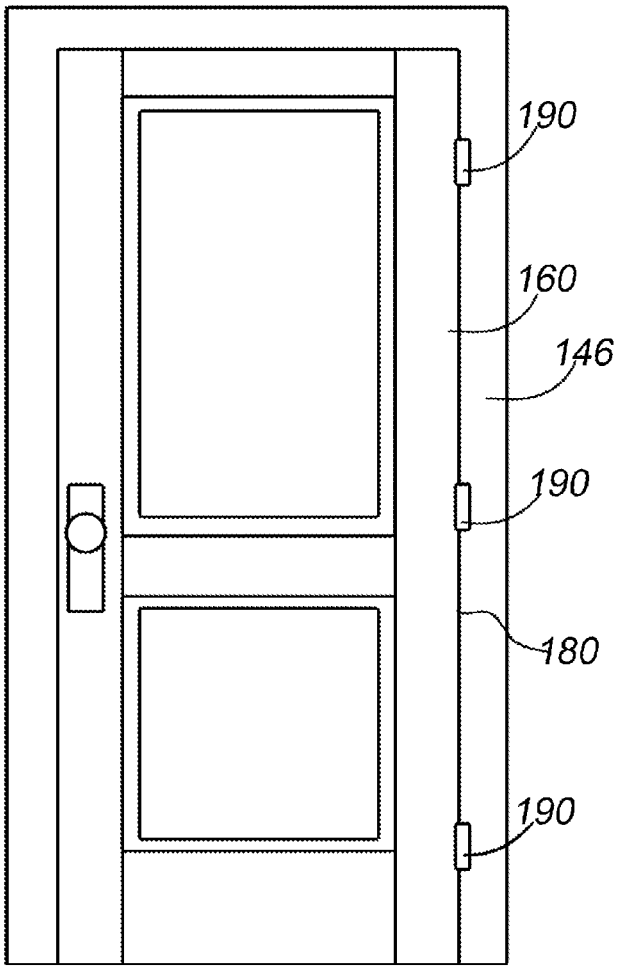

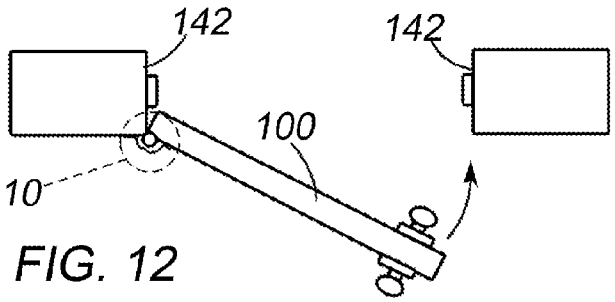
FIG. 12
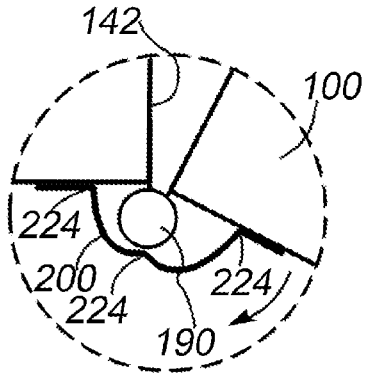
FIG. 13
FIG. 14
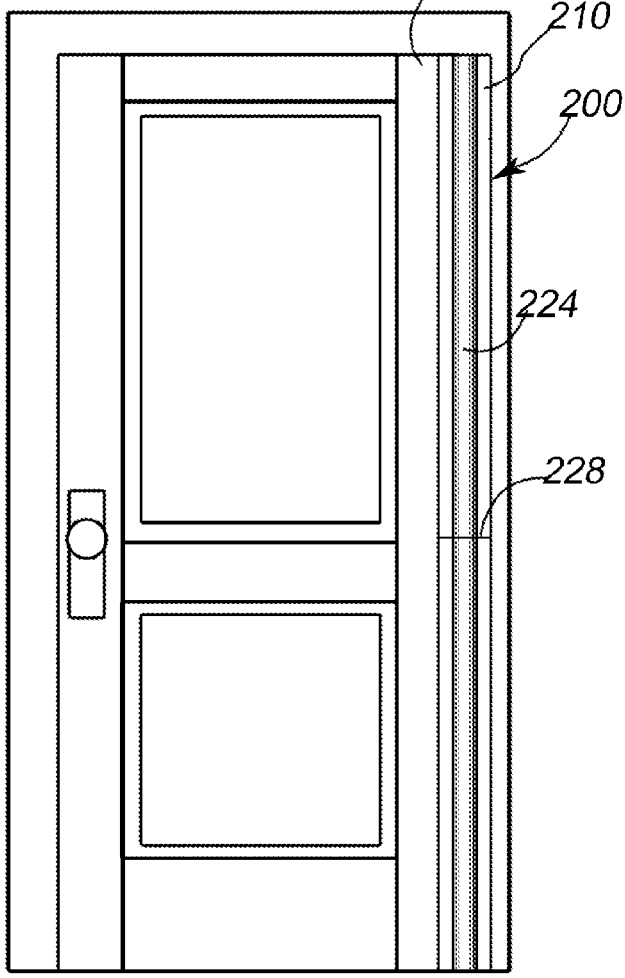

DEFORMABLE HINGE GAP BLOCKER FOR THE PROTECTION OF HANDS AND FINGERS

FIELD OF THE INVENTION

This invention relates to the field of injury prevention devices and more particularly, devices and methods to insure the safe operation of doors.

BACKGROUND OF THE INVENTION

The open area of a door hinge frequently attracts the eyes and exploring fingers of small children and accounts for 55% of door related injuries. If the door closes while fingers are within this area, as much as 40 tons of pressure per square inch is created easily crushing or pulverizing human tissue, and amputating fingers.

It has been reported that according to the National Safety Council—Injury Facts 2011 Edition; U.S. Consumer Product Safety Commission's National Electronic Injury Surveillance System, that approximately 380,800 door related injuries occur in the United States every year. Door related injuries occur at a rate of 31,000 month, 1,000 every day, 42 every hour and 1 every 1.4 minutes. According to one study; Clinical Pediatric Study: "Children Treated in the United States Emergency Departments for Door-related Injuries, 1999-2008", approximately eighty percent of door-related injuries occur to children in the home and approximately forty two percent of these children were under the age of four. Thousands of children every year are sent to the hospital with fractures, crushed and pulverized tissue or broken bones because portions of fingers and hands were caught in slamming doors.

Door injuries are very serious, disastrous, and potentially life changing. Amputations are a triple threat involving loss of function, loss of sensation, and loss of body image causing postoperative complications such as psychological problems, phantom pain, adverse emotional health, and needed psychosocial support. Individuals who earn their living from motor skills are especially vulnerable to amputations. Amputation in the preadolescent or adolescent age group is a great threat to emerging self image and sexual identity, and elderly amputees are at a greater risk for psychiatric disturbances such as depression, social isolation, new financial stringencies, and occupational limitations which complicate the adjustment to serious door hand injuries or finger amputations.

The true incidence of door-related injuries is underestimated because not all door related injuries are treated in hospital emergency departments and urgent care centers do not report statistics. Of the reported cases, tens of thousands of door related injuries result in finger amputations to children. Even one door injury is too many. Embodiments of the present invention can prevent most if not all of these types of injuries.

The present invention will not only prevent injury to children by unintended door closings, but will mitigate real potential legal and financial liability to many public and private facilities. There are many potential legal theories under which these public and private facilities having known and foreseeably unsafe doors can be found legally liable for these injuries including: premises liability, landowner-occupier duties, general negligence, attractive nuisance doctrine, products liability, and strict liability under codified health care safety codes as well as strict liability under building codes. For example, under the attractive nuisance doctrine, where the trespass of a child is likely, a landowner owes a duty to exercise ordinary care to avoid a foreseeable risk of harm posed by known dangerous artificial conditions, which result from the child's inability to appreciate the risk of harm. Many heavy commercial doors readily attract children. Some of these doors and door surrounds have attractive shiny metallic finishes or bright colored paint baiting the eyes and exploring fingers of children. Doors are easily accessible to the exploring fingers of young children who are unable to appreciate the dangerous condition of the unsafe doors which are potentially finger amputating instruments.

Liability under the attractive nuisance doctrine can be imposed as there now exists the inventor's known door hinge safety device which can be both be easily installed and installed at a small cost compared to the overall door installation. Thus, the cost of eliminating the known dangerous artificial condition of the finger amputating door is not so burdensome compared to the overall installation of the door and this duty of care to install hand and finger protecting devices should be afforded even with respect to child trespassers.

Landowner or occupier liabilities can attach even more easily than under the attractive nuisance doctrine since both landowner and occupier liability extends to licensees and/or invitees when they are injured in the face of known and foreseeable risks posed to them.

The Health and Safety Act from England is a piece of legislation enacted by the so UK legislature codifying health and safety regulations in the work place. It essentially spells out and mandates the "duty of care" employers have over the health, safety, and welfare of their staff in the workplace. Codified law imposes strict liability which eliminates the generally required "mens rea" or mental/intentional/intent element of a crime, ordinances, code, or statute.

Summarizing the codified law of the Health and Safety Act, the law asserts that an employer is required to manage the health and safety of the work place as to prevent accidents and ill-health. In complying with the law the employers/landowners are required to identify and avoid physical hazards, carry out risk assessments, and even prepare written safety statements. These physical hazards of the codified Health and Safety Act would extend to having a duty of care to prevent finger-trapping accidents in doors and gates. Risks posed by all doors and gates must be assessed and reasonable precautions taken to ensure that the doors can be safely used. Since hand and finger guarding devices are readily available, easy and inexpensive to install, not doing so has been found to be a breach of the duty of care imposed by the Health and Safety Act of the UK and similar codified law that is likely to become more and more prevalent throughout the United States.

A nursery in the suburb of Norwich in the English county of Norfolk was fined £75,000 for the nursery's breach of its imposed "duty of care" under the Health and Safety Act for the nursery's omission in not installing door finger guards. The injury sustained in that nursery in which a 14-month old had his finger amputated from a door closing was of the same type of injury that the Health and Safety Code was designed to prevent and thus liability was found.

Throughout the United States there is an abundance of well settled case law upholding strict liability for crimes in which apartment owners, landlords, and occupiers has violated health, building, public safety, and fire prevention code, ordinances, statutes, and regulations.

In the case of *People v. Bachrach* (1980) 114 *Cal.* 3*d Supp.* 8, 170 *Cal. Rptr.* 773 the owner of an apartment building who was being prosecuted for violation of a number of provisions in an ordinance relating to public safety and fire prevention, the court no rejected the defendant's proposed jury instruction which provided that "there must be a joint operation of act or conduct and criminal intent." The court found that the crimes which the apartment owner was charged with did not require proof of guilty knowledge or intent. It held that the doctrine of strict liability applied and therefore neither intent nor criminal negligence was an essential element of the crimes charged.

The Court in the case of the *People v. Balmer* (1961) 196 *Cal. App. 2d Supp.* 874 dealt with statutes and offenses of a regulatory nature that were found to be enforceable irrespective of criminal intent or criminal negligence. In this case the defendants were being convicted for owning and operating a nursing and convalescent home without keeping it in good repair and in a neat and sanitary condition at all times. The court held that neither guilty knowledge nor intent had to be shown and that the mere omission to fulfill the required standard constituted the crime charged.

As more codified law, codes, statutes, and regulations are promulgated throughout the various states, cities and municipalities within the United States, we will see more criminal liability imposed, fines, and penalties for breaches in violations of failure to take precautions to ensure door safety.

Thus, the benefits of the invention surpass the mitigation of hand and finger injuries by extending to mitigate real financial and legal liabilities.

DESCRIPTION OF PRIOR ART

Major problems facing current users of door safety closure prevention devices is that many such devices require modifications to door or door frame construction. Moreover, such devices do not fully and effectively occlude a door hinge gap when the door is transitioned from an open position to a closed position and from a closed position to an open position sufficient to prevent hands and fingers from being crushed, injured, or amputated. Further, many door safety closure prevention devices are just movable stops that many times get displaced from their original intended position and fail to prevent a door from closing.

For at least the foregoing reasons, there is a need for a door safety closure device that will prevent hands and fingers from being crushed, injured, or amputated within the hinge area of the door and door surround. Moreover, the invention will prevent the economic loss of serious door injuries resulting from loss of livelihood, increased government disability payments, and diminished functional capacity of the amputees. Further, the invention will mitigate financial and legal liability that is created under legal causes of action filed under premise liability, landowner-occupier liability, general negligence, attractive nuisance doctrine, products liability, and strict liability violations of health and safety code violations as well as building code violations.

SUMMARY

The present invention is directed to a hand and finger door protector for residential and commercial doors that will protect hands and fingers from being crushed, pulverized, amputated or just plain injured in a hinge gap of the door and door surround by the unintended slamming or closing of the door. Embodiments of this invention are designed to be used with any type of pivoting door and occlude the hinge gap of the door at all times and at all door positions.

The apparatus and method disclosed herein prevents injury to body parts resulting from door closure. The apparatus and method described herein achieve injury prevention by the steps of providing a door frame and a door wherein portions of the door frame are installed with a specially shaped apparatus having portions that occlude the hinge gap of a door when opening or closing the door. More specifically, the hinge gap blocking apparatus has a curved or vaulted portion that occludes the hinge stile gap on the side of the door with outwardly exposed hinge barrels, and covers the gap and hinge barrels, and which deforms when the door is pivoted on its hinges. The apparatus completely spans the hinge stile gap from the hinge stile of the door to the door frame casing, so that fingers cannot pry around the vaulted portion and thus risk exposure to injury and amputation the hinge gap of the door.

The hinge gap blocker is typically attached to the outside edge of the door hinge stile and the door casing, and comprises a pair of flanges for affixing to the hinge stile of a door and doorway casing. An vaulted portion is formed between the flanges. Once the apparatus is installed, the vaulted portion overlays and occludes the hinge stile gap between the hinge stile of the door and the door jamb. When the door is pivoted on its hinges, the vault deforms along a living hinge that runs longitudinally down the vault apex. Once installed, the hinge stile gap is occluded by the apparatus at all times irrespective of door position.

Factors and Aspects of the Invention

First, the inventor is not aware of existing hand and finger door safety devices that occlude the hinge stile gap of a door in the manner of the present invention.

Second, embodiments of this invention include mounting means that include one or more mounting portions which may be affixed to the hinge stile of a door and portions a door frame or doorway casing using threaded fasteners, adhesives or other such fastening means as will be appreciated by those skilled in the art, facilitating quick installation.

Third, embodiments of the apparatus may possess one or more sections for spanning the distance of an inner door frame between hinges, or, one or more sections that overlay the hinge stile gap to include the hinge barrels.

Fourth, embodiments of the present invention may include multiple sections; e.g., by severing, sawing or separating smaller sections from a larger section wherein the smaller sections are custom fitted to span the distance of an inner door frame between hinges, or, include pre-sized section(s) that overlay a hinge to provide a continuous outwardly facing section of a hinge stile gap blocker.

For at least the foregoing reasons, there is a need for apparatus and method designed to prevent door closure injuries resulting from placement of fingers and hands into the hinge stile gap of open doors. Embodiments of the invention, the details and features of which are shown in the drawing figures and detailed description that follow will reduce the risk of hand and finger injuries and amputations, lessen the economic loss of serious door injuries due to loss of livelihood, lessen government disability payments, prevent amputation and the sequelae of diminished functional capacity of the amputees and reduce the risk of legal causes of action against premises having foreseeably dangerous doors.

The foregoing and other objects, features, and advantages of the invention will become more apparent from the following detailed description, which proceeds with reference to the accompanying figures wherein the scale depicted is approximate.

BRIEF DESCRIPTION OF THE DRAWING FIGURES

FIG. 9 depicts a top edge view of a typical hinged door;

FIG. 10 is a detail view of the call-out (10) of (FIG. 9);

FIG. 11 is a front view of a typical door and door surround including exposed hinge barrels;

FIG. 12 depicts in a top edge view, an exemplary installation of one embodiment of a hand and finger protector;

Figure 15:
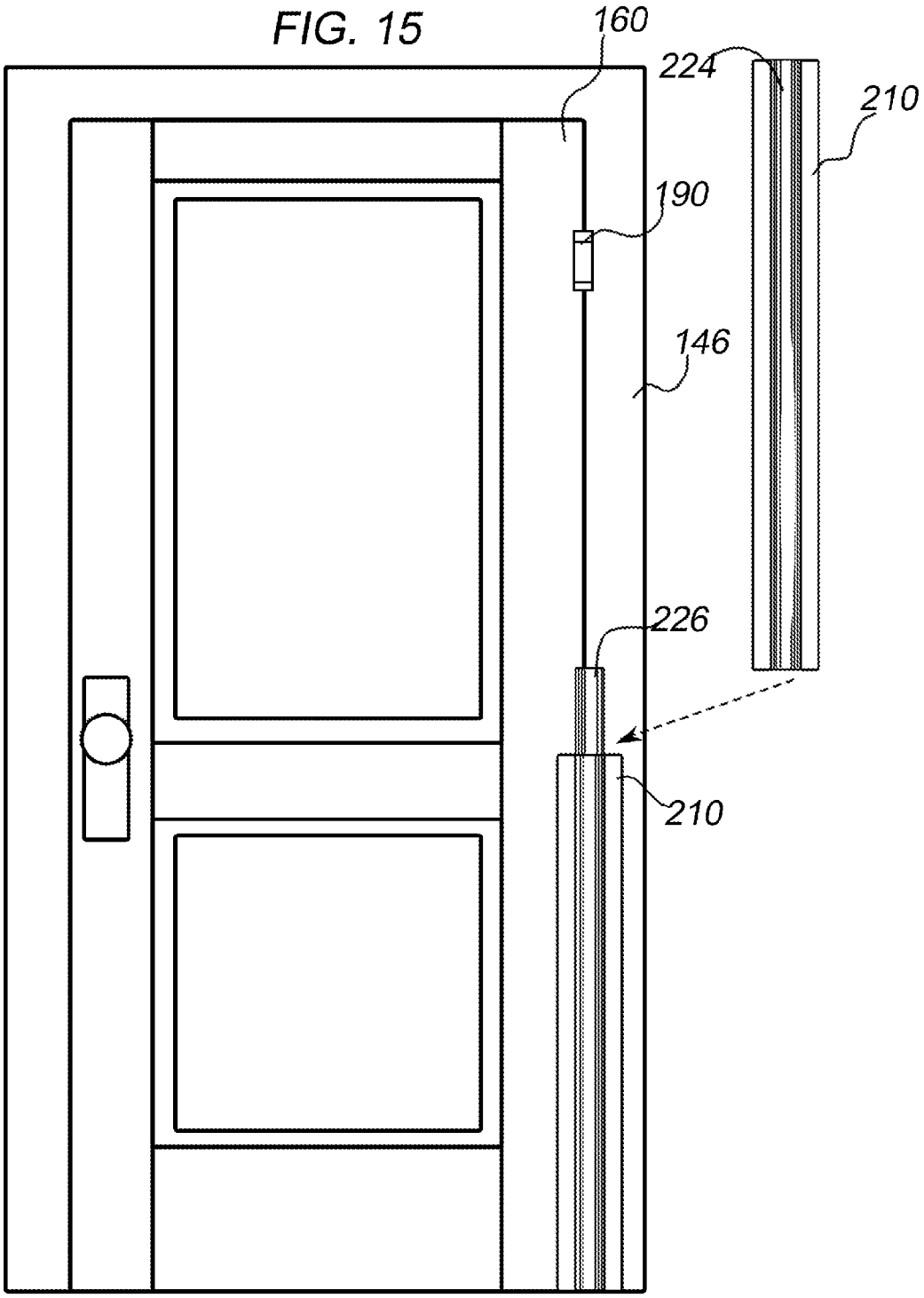

FIG. 13 in an enlarged view of call out (13) of (FIG. 12);

FIG. 14 depicts an exemplary installation of one embodiment of a hand and finger protector to a door and door casing;

FIG. 15 illustrates a typical installation whereby multiple sections of a hand and finger protector are aligned with the hinge stile gap.

REFERENCE LISTING OF THE NUMBERED ELEMENTS

100 door
120 door leading edge
130 door surround
140 door frame
142 door jamb
144 door jamb stop
146 door casing
160 outer edge hinge stile
180 hinge stile gap
190 door hinge barrel
200 hinge stile gap blocker
210 flange
212 adhesive
220 vault
224 living hinge
226 connector
228 joint

DEFINITIONS

In the following description, the term "door" as used herein, includes pivoting or hinging panels that are designed to occlude a doorway. The term "door closure" as used herein, means the edge of the door is substantially flush with a door surround and wherein there is minimal gap between the edges of the door and the frame. The term "door surround" as used herein, means the structure surrounding a door, whether outward facing or inward facing, and includes raised molding (casing), or other non-raised surface, e.g., wall or cabinetry surfaces directly adjacent to—or abutting the door's edge(s). The term "door jamb" as used herein, refers to portions of the door frame that are typically at a right angle relative to the casing of the door when the door is shut. The term "leading edge" also known as the "shutting stile," refers to that portion of a door that leads when the door is being moved from an open to closed position; e.g., the lock stile of a rail and stile door. The term "hinge stile" refers to the vertical portion of a door edge to which hinges are affixed and about which the door pivots. The term "hinge stile gap" refers to the gap created between the hinge stile of a door and a door frame when the door is partially or wholly opened. As used herein, "fasteners" means any customary means to fasten one object to another, including threaded fasteners, non-threaded fasteners, staples, tape, adhesives, welding, or other means as will be appreciated by those having skill in the art and benefit of this disclosure whether for permanent or semi-permanent use. Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting.

Referring generally to FIGS. 1-15, embodiments according to the present invention for a hand and finger protector and a method for preventing injuries resulting from insertion of hands and fingers into a hinge stile gap 180 of a door 100 include, a door hinge stile gap blocker 200 having attachment portions; typically flanges 210 for affixment and alignment to portions of a door, and a vaulted portion 220, sufficient to cover the hinge barrels of a hung door as well as the hinge stile gap. Flanges 210 attach to sides of the hinge stile 160 of a door and also to the surrounding door casing 146, and may include adhesive members 212 attached to the door contacting portions such as double stick tape. At least one living hinge 224 runs lengthwise along the apex of vault 220, and, as best shown in (FIG. 11), defines a longitudinal deformation line for the vaulted portion once the hinge gap blocker is installed, and the door is pivoted. It should be understood that although in the embodiment shown herein, vaulted portion 220 is depicted having a bilaterally symmetrical arch, the vaulted portion may be include other profiles as will be appreciated by those having skill in the art and benefit of this disclosure. For example, the vaulted portion may be an arch, or other vaulted structure, either bilaterally symmetrical or asymmetrical, and, may include flat sides, longitudinal edges and facets. One side of the vaulted portion may be longer than the other. Flanges 210 may differ in their respective dimensions; e.g., width, thickness. In any case, the vaulted portion is sufficient to cover over exposed barrel hinges that are present alongside the outer face of the door, typically between the door and door jamb or the door and the door casing. As best shown in (FIGS. 4-6), a living hinge 224 resides between either side of vaulted portion 220 and each flange 210 which enables the structure to deform; i.e., regularly fold lengthwise, during use.

Typically, the apparatus is a multi-part assembly as best depicted in FIGS. 14 and 15, wherein sections of the hinge gap blocker 200 are aligned with adjacent sections along a length of the door hinge stile when the door is closed. Flanges 210 provide a straight edge that facilitates easy alignment to a reference point on the door and the door casing. Insertable members 226 which are configured to nest in terminal ends of the sections by snap fit, friction fit or adhesives, provide easy alignment of adjacent sections of the hinge gap blocker along portions of a door and door casing. The contacting surface of the inserts for contact with the inside surfaces of the vaulted portion may be pre-coated with an adhesive with a peel away backing to facilitate their installation to the hinge gap blocker sections. The hinge stile gap blocker may be provided in multiple sections of pre-determined length, or, one or more sections may be cut to length by an installer.

Embodiments of the hinge stile gap blocking apparatus may be retrofitted to an existing door and door jamb, or, may be pre-installed on pre-hung doors. Alternately, the apparatus may be provided in a kit form suitable for home or commercial use. The hinge stile blocking apparatus may be incorporated into wood, plastic or metal commercial door frames at the time of manufacture.

Figures 1, 2, 3, 4, 5, 6:
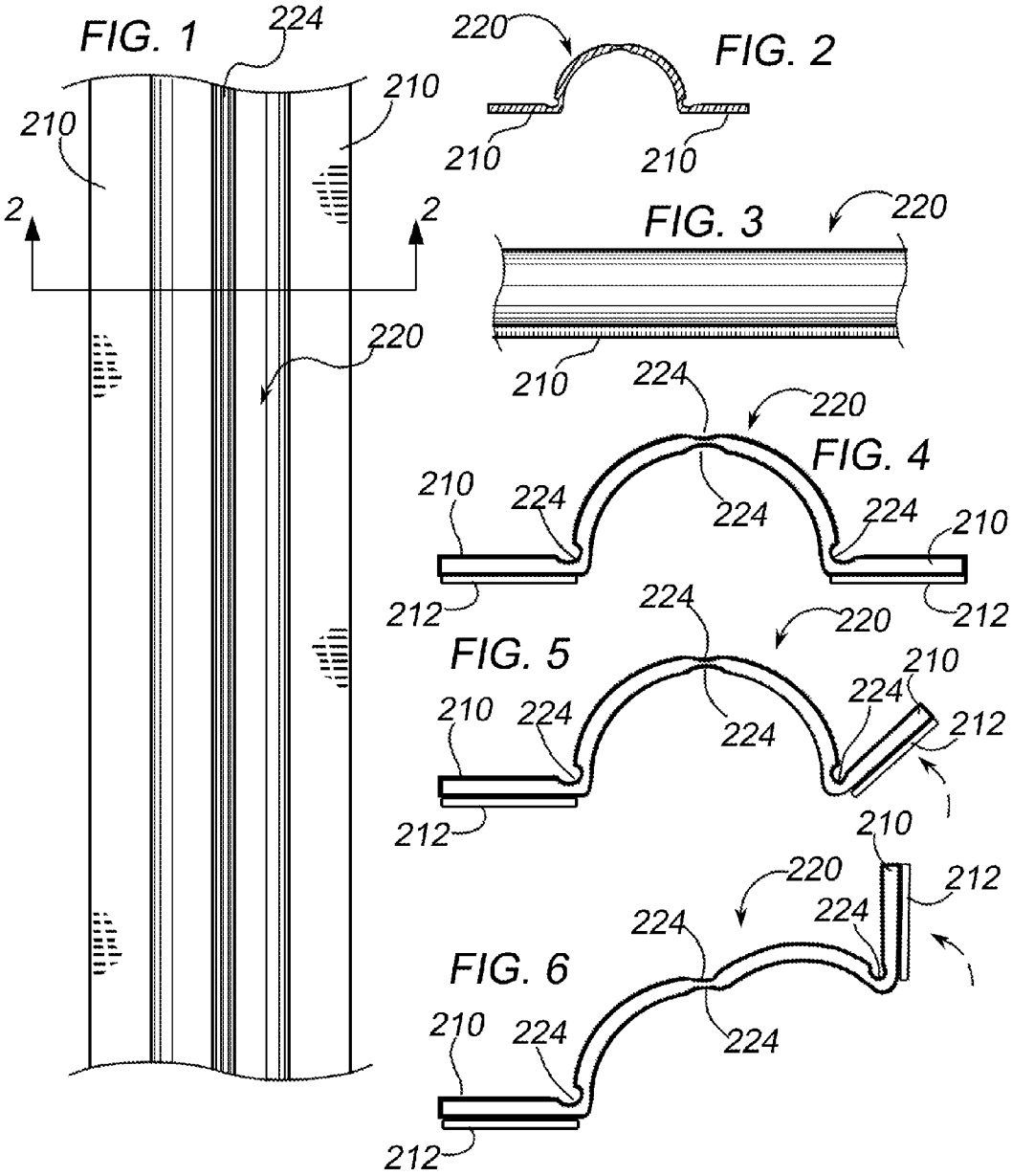
FIG. 1 is a top plan view of a partial section of one embodiment according to the present invention.
FIG. 2 is a cross-sectional view thereof taken along lines 2-2 of (FIG. 1)
FIG. 3 is side elevation thereof.
FIG. 4 is a first enlarged end view thereof.
FIG. 5 is second enlarged end view thereof.
FIG. 6 is third enlarged end view thereof.

FIG. 1 shows a top plan view of a section of hinge gap blocker with flanges 210 separated by a vaulted portion 220. As best depicted in FIGS. 4-6, a living hinge separates the vaulted portion from each flanges and a living hinge runs longitudinally down the vaulted portion. The hinge gap blocker is preferably constructed of a flexible tough plastic such as a vinyl, a polyethylene, a polypropylene or comparable material that will suggest itself to those having skill in the art and benefit of this disclosure.

Figure 7:
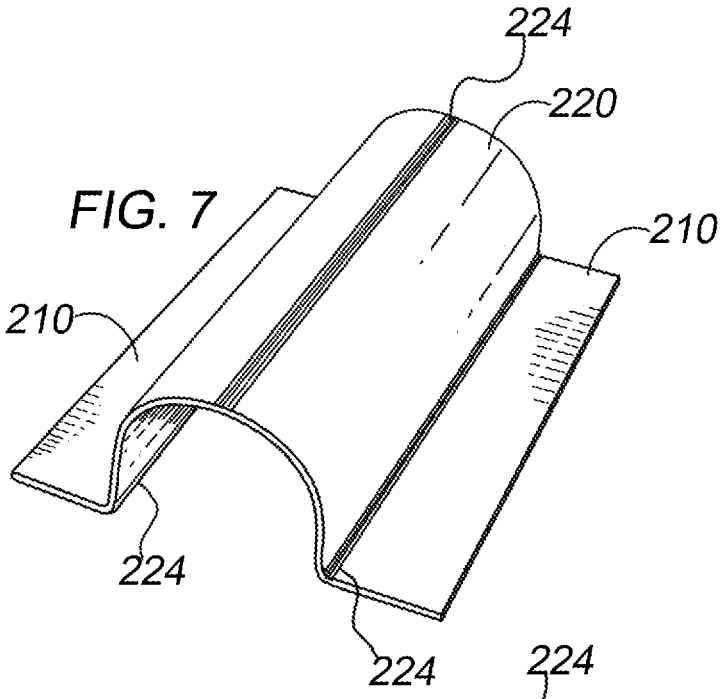
FIG. 7 is a perspective view thereof.
Figure 8:
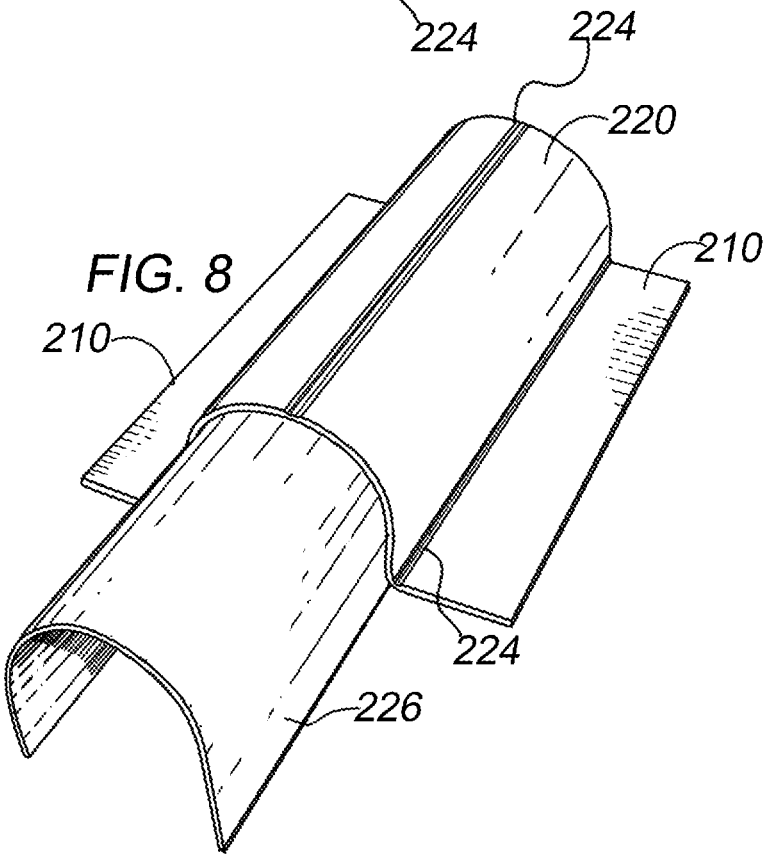
FIG. 8 is a perspective view thereof showing an insertable connector.

FIGS. 7 and 8 are respectively, perspective view of sections of the hinge gap blocker 200 with flanges 210, vaulted portion 220 and living hinges 224, and with connector 226 inserted as an aid to alignment and to bridge and join abutting sections of the hinge gap blocker.

FIGS. 9-11 and FIGS. 12-14 show respectively, for comparative purposes and to better clarify the advantages of the present invention, a typical door installation that results in a hinge stile gap on both sides of a door, and a door installation with the hinge gap blocker apparatus that eliminates the hinge stile gap on the outer facing side of the door.

FIG. 15 depicts a lowermost section of a hinge stile gap blocker 200 affixed to the hinge stile 160 of a door and the door casing 146 wherein connector 226 is covering an exposed hinge barrel 190. A second uppermost section of the hinge gap blocker 200 is fitted into place abutting the lowermost section using the connector for alignment purposes.

The following is merely one exemplary method of installation according to embodiments of the invention:

(1) providing at least one section of a hinge stile gap blocker, wherein the at least one section has an attachment portion, and, formed with the attachment portion, a vaulted portion;

(2) marking the hinge stile of the door and door casing;

(3) aligning the at least one section of the hinge stile gap blocker along the hinge stile of the door;

(4) aligning edges of the attachment portion to portions of the door and door casing so that the hinge stile gap is occluded for all door positions; and, (5) attaching the hinge stile gap blocker to the door and door casing.

It should be understood that the drawings and detailed description herein are to be regarded in an illustrative rather than a restrictive manner, and are not intended to be limiting to the particular forms and examples disclosed. Accordingly, it is intended that this disclosure encompass any further modifications, changes, rearrangements, substitutions, alternatives, design choices, and embodiments as would be appreciated by those of ordinary skill in the art having benefit of this disclosure, and falling within the scope of the following claims.

What is claimed is:

1. A door safety apparatus for protecting hands and fingers comprising:

at least one hinge gap blocker member configured to continuously occlude a gap created between a door jamb and an outer facing edge of a door hinge stile of a door when the door is transitioned from an opened state to a closed state or from a closed state to an open state, and the hinge gap blocker further comprising:

a deformable vaulted portion for bridging a hinge stile gap having flanges at sides of the vaulted portion configured to attach the at least one hinge gap blocker member to at least the hinge stile of the door and a casing portion of a door surround of the door;

at least three living hinges including:

a first living hinge and a second living hinge each disposed at a nexus between flanges and the deformable vaulted portion, and, a third living hinge being thinner than that of the first and second living hinge in the hinge gap blocker member longitudinally formed at crown of the deformable vaulted portion configured to deform slightly inwardly toward the hinge stile gap when the door to which the hinge gap blocker is attached is transitioned from a closed state to an open state.

2. The at least one hinge gap blocker member according to claim 1 having ends that are configured to align with an adjacent hinge blocker member when multiple blocker members are installed.

3. The apparatus according to claim 1 wherein the at least one hinge gap blocker member is multi-part.

4. The at least one hinge gap blocker member according to claim 1 further comprising an alignment means including straight edges for alignment to an edge of the door or door frame.

5. The apparatus according to claim 1 wherein the at least one hinge gap blocker member is configured to nest with another hinge gap blocker.

6. The apparatus according to claim 1 wherein the at least one hinge gap blocker member is foldable lengthwise.

7. The apparatus according to claim 1 wherein the fastening means is selected from the group consisting of: adhesives, hook and loop fasteners, threaded fasteners, nails.

8. A method of altering a door to protect hands and fingers comprising the steps of:

(1) providing at least one hinge gap blocker member with a vaulted portion configured to continuously occlude a door hinge gap when the door is transitioned from an open position to a closed position and from a closed position to an open position, a pair of flanges, each flange to the side of the vaulted portion, and, at least three living hinges including:

a first living hinge and a second living hinge each disposed at the nexus between flanges and the deformable vaulted portion, and, a third living hinge being thinner than that of the first and second living hinge longitudinally formed along a crown of the deformable vaulted portion configured to deform slightly inwardly toward the hinge stile gap when transitioning the door from a closed state to an open state; and, (2) attaching a portion of the at least one hinge gap blocker member to casing portions of a door surround of the door wherein portions of the blocker member project outwardly along the hinge stile of the door, and wherein the vaulted portion covers exposed hinge barrels of the door installation.

9. The method according to claim 8 wherein the at least one hinge gap blocker member is adapted to abut another hinge gap blocker member and align with an edge of the door when installing.

10. The apparatus according to claim 8 further comprising the step of aligning portions of the at least one hinge gap blocker member to the door jamb.

11. The apparatus according to claim 8 wherein the at least one hinge gap blocker member is longitudinally deformable when the door is transitioned from an open position to a closed position and from a closed position to an open position.

12. The method according to claim 8 wherein the at least one hinge gap blocker member possesses a hinging portion in the vaulted portion.

13. The method according to claim 8 wherein fastening means for fastening the at least one hinge gap blocker member to portions of the door surround is selected from the group consisting of: adhesives, hook and loop fasteners, threaded fasteners, nails.

* * * * *